US006263519B1

(12) United States Patent
Parsons et al.

(10) Patent No.: US 6,263,519 B1
(45) Date of Patent: Jul. 24, 2001

(54) AUTOMATIC TANK-TYPE FLUSHER

(75) Inventors: Natan E. Parsons, Brookline; David W. Hadley, Franklin, both of MA (US)

(73) Assignee: Arichell Technologies, Inc., West Newton, MA (US)

( * ) Notice: Subject to any disclaimer, the term of this patent is extended or adjusted under 35 U.S.C. 154(b) by 0 days.

(21) Appl. No.: 09/544,800

(22) Filed: Apr. 7, 2000

(51) Int. Cl.[7] ..... E03D 1/00
(52) U.S. Cl. ..... 4/313; 4/300; 4/362; 4/378
(58) Field of Search ..... 4/359, 354, 362, 4/406, 407, 378, 300, 313; 251/144, 129.02, 30.01, 30.02, 30.03

(56) References Cited

U.S. PATENT DOCUMENTS

| | | | | |
|---|---|---|---|---|
| 1,332,995 | | 10/1973 | Gibbs et al. . | |
| 2,858,546 | | 11/1958 | Tekenos | 4/68 |
| 2,957,181 | * | 10/1960 | Lamping | 4/354 |
| 3,628,195 | * | 12/1971 | Skousgaard | 4/26 |
| 3,817,279 | | 6/1974 | Larson | 137/572 |
| 3,817,489 | | 6/1974 | Caron et al. | 251/38 |
| 3,820,171 | | 6/1974 | Larson | 4/31 |
| 3,820,754 | | 6/1974 | Caron et al. | 251/38 |
| 4,034,423 | | 7/1977 | Milnes | 4/41 |
| 4,060,857 | * | 12/1977 | Couton | 4/26 |
| 4,141,091 | | 2/1979 | Pulvari | 4/313 |
| 4,193,145 | | 3/1980 | Gross et al. | 4/346 |
| 4,233,698 | | 11/1980 | Martin | 4/354 |
| 4,304,015 | | 12/1981 | Hubatka | 4/407 |
| 4,357,720 | | 11/1982 | Stahli | 4/378 |
| 4,575,880 | | 3/1986 | Burgess | 4/313 |
| 4,662,395 | | 5/1987 | Strangfeld | 137/614.19 |
| 4,756,031 | | 7/1988 | Barrett | 4/407 |
| 4,832,310 | | 5/1989 | Nestich | 251/36 |
| 4,941,215 | | 7/1990 | Liu | 4/406 |
| 4,955,921 | * | 9/1990 | Basile et al. | 4/354 |
| 5,003,643 | | 4/1991 | Chung | 4/313 |
| 5,187,818 | | 2/1993 | Barrett, Sr. et al. | 4/313 |
| 5,313,673 | | 5/1994 | Saadi et al. | 4/313 |
| 5,335,694 | | 8/1994 | Whiteside | 137/625.37 |
| 5,341,839 | | 8/1994 | Kobayashi et al. | 137/505.13 |
| 5,361,426 | | 11/1994 | Martin | 4/361 |
| 5,400,446 | | 3/1995 | Bloemer et al. | 4/408 |
| 5,431,181 | | 7/1995 | Saadi et al. | 31/40 |
| 5,603,127 | | 2/1997 | Veal | 4/246.1 |
| 5,649,686 | | 7/1997 | Wilson | 251/40 |
| 5,652,970 | * | 8/1997 | Wodeslavsky | 4/378 |
| 5,884,667 | | 3/1999 | North | 138/43 |
| 5,926,861 | * | 7/1999 | Frost | 4/378 |

FOREIGN PATENT DOCUMENTS

| | | |
|---|---|---|
| 312750B1 | 4/1989 | (EP) . |
| 0828103 A1 | 3/1998 | (EP) . |
| 2277108 | 10/1994 | (GB) . |
| 2277750 | 11/1994 | (GB) . |
| 2329452 | 3/1999 | (GB) . |
| 98/06910 | 2/1998 | (WO) . |
| 98/10209 | 3/1998 | (WO) . |

* cited by examiner

*Primary Examiner*—Gregory L. Huson
*Assistant Examiner*—Huyen Le
(74) *Attorney, Agent, or Firm*—Cesari and McKenna, LLP

(57) ABSTRACT

Pressure from the input water line (26) holds a toilet's flush-valve member (12) in its seat so as to prevent water in the toilet tank (16) from flowing through flush ports (18) and a flush conduit (22) into the toilet bowl or urinal. To release water through the flush conduit (22) a solenoid (42) is actuated to relieve the pressure acting on the flush-valve (12) so that a bias spring (24) lifts the flush-valve (12) off its seat (14). A solenoid (118) for performing this function can be located remotely from the flush-valve assembly and communicate with it by a hydraulic line (108).

9 Claims, 9 Drawing Sheets

AUTOMATIC TANK-TYPE FLUSHER

BACKGROUND OF THE INVENTION

FIELD OF THE INVENTION

The present invention is directed to toilet flushing. It finds particular, although not exclusive, application in automatic tank-type flushers.

BACKGROUND INFORMATION

The art of toilet flushers is an old and mature one. (We use the term toilet here in its broad sense, encompassing what are variously referred to as toilets, water closets, urinals, etc.) While many innovations and refinements in this art have resulted in a broad range of approaches, flush systems can still be divided into two general types. The first is the gravity type, which is used in most American domestic applications. The gravity type uses the pressure resulting from water stored in a tank to flush the bowl and provide the siphoning action by which the bowl's contents are drawn from it. The second type is the pressurized flusher, which uses line pressure more or less directly to perform flushing.

Some pressure-type flushers are of the tank type. Such flushers employ pressure tanks to which the main water-inlet conduit communicates. Water from the main inlet conduit fills the pressure tank to the point at which air in the tank reaches the main-conduit static pressure. When the system flushes, the water is driven from the tank at a pressure that is initially equal to that static pressure, without reduction by the main conduit's flow resistance. Other pressure-type flushers use no pressure tank, and the main conduit's flow resistance therefore reduces the initial flush pressure.

While flush-mechanism triggering has historically been performed manually, there is also a long history of interest in automatic operation. Particularly in the last couple of decades, moreover, this interest has resulted in many practical installations that have obtained the cleanliness and other benefits that automatic operation affords. As a consequence, a considerable effort has been expended in providing flush mechanisms that are well adapted to automatic operation. Automatic operation is well known in pressure-type flushers of the non-tank variety, but gravity-type flushers and pressurized flushers of the tank variety have also been adapted to automatic operation.

European Patent Publication EPO 0 828 103 A1 illustrates a typical gravity arrangement. The flush-valve member is biased to a closed position, in which it prevents water in the tank from flowing to the bowl. A piston in the valve member's shaft is disposed in a cylinder. A pilot valve controls communication between the main (pressurized) water source and the cylinder. When the toilet is to be flushed, only the small amount of energy required for pilot-valve operation is expended. The resultant opening of the pilot valve admits line pressure into the cylinder. That pressure exerts a relatively large force against the piston and thereby opens the valve against bias-spring force. Pilot valves have similarly been employed to adapt pressure-type flushers to automatic operation.

SUMMARY OF THE INVENTION

But we have recognized that both gravity- and pressure-type flush mechanisms can be improved by changing the fluid circuits that the pilot valves ultimately control.

In the case of the gravity-type flush valve, we have recognized that operation can be made more repeatable by simply employing a configuration that is the reverse of the one described in the above-mentioned European patent publication. Specifically, we bias our flush valve to its unseated state, in which it permits flow from the tank to the bowl, and we use line pressure to hold the flush valve shut rather than to open it. We have recognized that this approach makes it very simple to have a repeatable valve-opening profile. Also, high line pressure actually aids in preventing leakage through the flush valve, rather than tending to reduce the effectiveness of the flush-valve seal. Since the toilet's suction generation is principally dependent on that profile, and since our approach makes the bias mechanism essentially the sole determinant of that profile, our approach enables this aspect of flush operation to be largely independent of line pressure.

We have also recognized that pressure-type flush systems adapted for automatic operation can be simplified by providing a pressure-relief passage that extends through the flush-valve member itself. Specifically, part or all of the valve member is disposed in a pressure chamber, into which line pressure is admitted. This pressure overcomes a bias force and holds the valve member in its seated position, in which it prevents flow from the pressurized-liquid source into the bowl. To open the flush valve, it is necessary to relieve the pressure in the pressure chamber by venting it into some unpressurized space. Rather than follow the conventional approach of providing an additional pressure-relief exit from the flush mechanism, we use the flush outlet for pressure relief by providing a pressure-relief conduit that extends from the pressure chamber through the flush-valve member itself. A pressure-relief mechanism ordinarily prevents flow through this pressure-relief conduit, but it permits such flow when the toilet is to be flushed.

In both pressure- and gravity-type systems, much of the mechanism employed to operate the flush valve is typically local to the wet region. That is, it is inside the pressure vessel in the case of a pressure-type system, and it is in the tank below the high-water line in case of a gravity-type system. For automatic operation, though, at least some part, such as a lens used as part of an object sensor to collect light reflected from the object, is disposed at a remote location. So there must be some communication between the local and remote regions.

In accordance with one aspect of the invention, this communication is totally hydraulic: a pressure-relief line extends from the local region to a remote region outside the pressure vessel or outside the part of the tank interior below the high water line, and a remote valve controls flow that pressure-relief line to control the flush valve's operation. By employing this approach, we are able to eliminate the need to provide a sealed enclosure for the electrical components.

BRIEF DESCRIPTION OF THE DRAWINGS

The invention description below refers to the accompanying drawings, of which.

DETAILED DESCRIPTION OF ILLUSTRATIVE EMBODIMENTS

Figure 1:
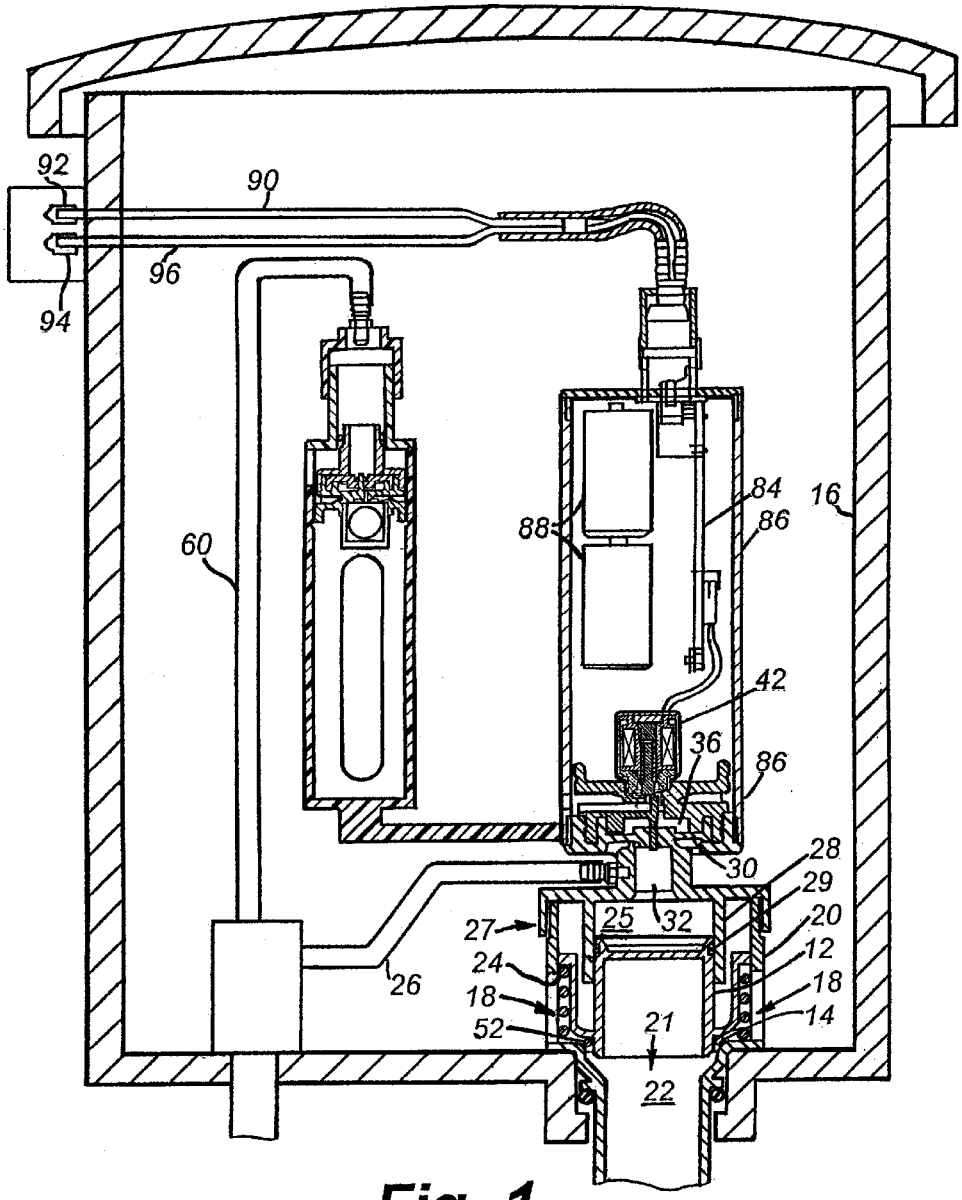
FIG. 1 is a sectional view of a toilet tank illustrating its float and gravity-type flush valves.

In the state that FIG. 1 depicts, a gravity-type flush mechanism's flush-valve member 12 is seated in a flush-valve seat 14 formed in the bottom of a toilet tank 16. In that seated position, the valve member 12 prevents water from the tank 16 that has entered through flush ports 18 in a flush-valve housing 20 from flowing through a flush outlet 21 and a flush conduit 22 to a toilet.

Figure 2:
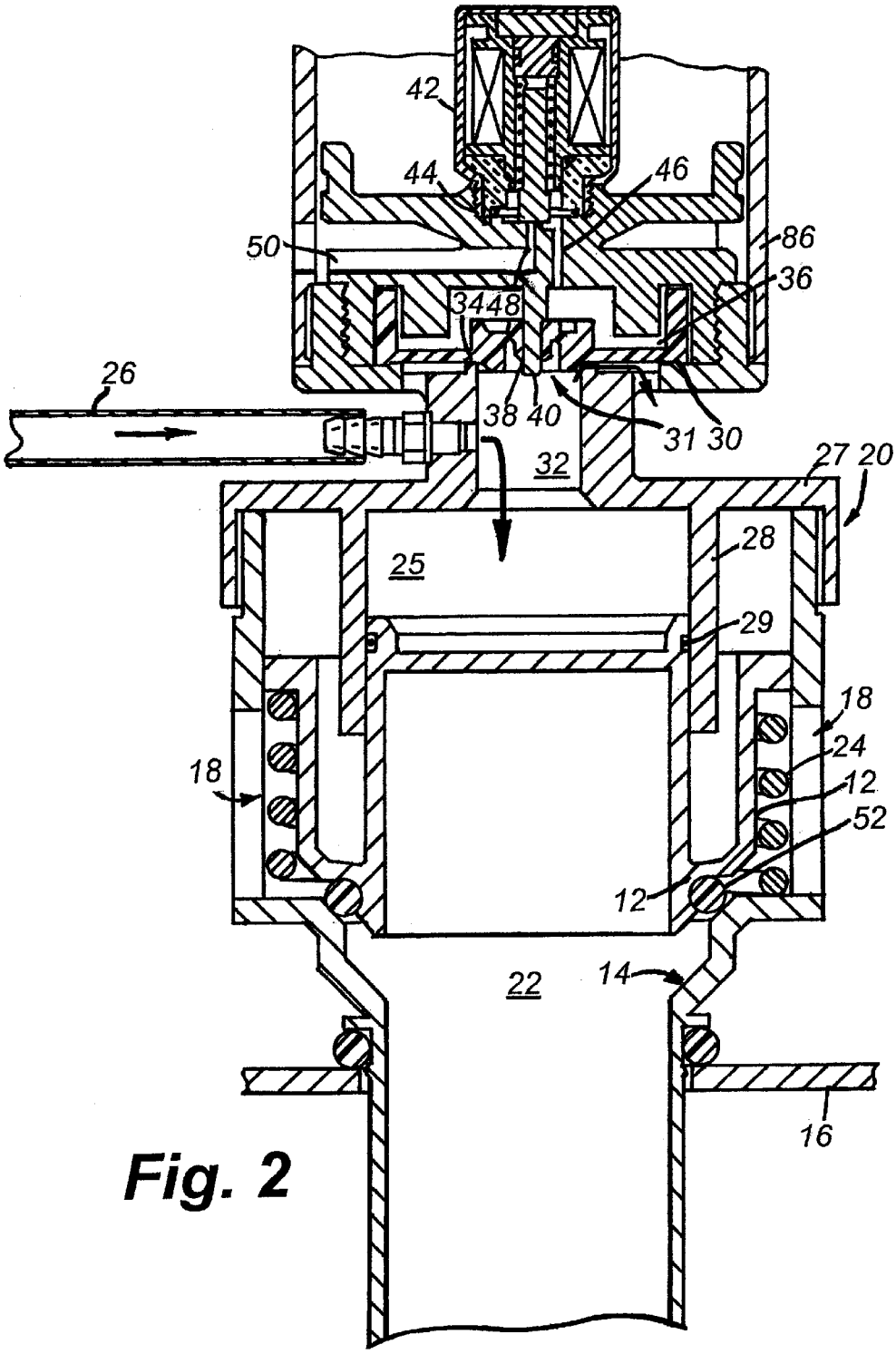
FIG. 2 is a more-detailed cross section of the gravity-type flush valve in its closed state.

As FIG. 2 shows, the flush mechanism includes a bias spring 24. The bias spring exerts a force that tends to urge the flush-valve member 12 off its seat 14. But the flush-valve member remains seated between flushes because of pressure that normally prevails in a chamber 25 because of its communication with a (pressurized-) water source conduit 26. The flush-valve housing 20's cap 27 provides this chamber, and the flush-valve member is slidable within a cylinder 28 that the cap forms.

The valve member's seal ring 29 cooperates with a pilot-valve diaphragm 30 to prevent escape of the pressurized water from the piston chamber 25 through a pressure-relief outlet 31 in chamber 25's narrowed passage portion 32. The pilot-valve diaphragm 30 is resiliently deformable, so the pressure that prevails within passage 32 would tend to lift it from engagement with the pilot-valve seat 34 if a similar pressure did not prevail within pilot chamber 36 and act on the diaphragm 30 over a greater area. The reason why this pressure prevails within chamber 36 is that a small orifice 38 through which a pilot-valve pin 40 extends permits water to bleed into it (through a relatively high flow resistance).

Figure 3:
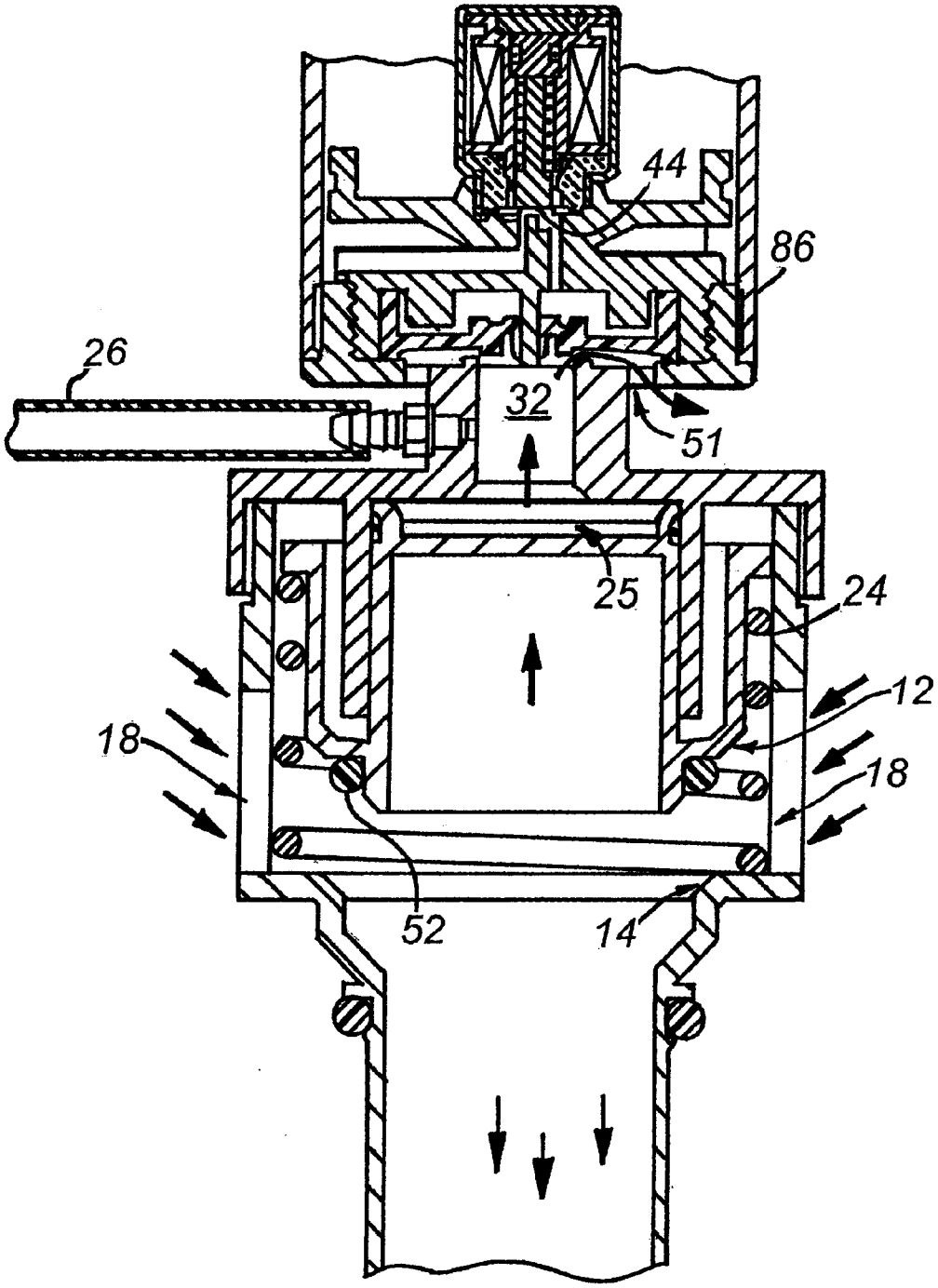
FIG. 3 is a similar view of the gravity-type flush valve, but in its open state.

To cause the system to flush, a solenoid 42 withdraws a second pilot-valve member 44 from a seat in which it prevents flow through a passage 46 that leads from chamber 36 to a further passage 48 that leads to an outlet 50. The flow resistance through passages 46 and 48 is much lower than that through the bleed orifice 38, so the pressure within chamber 36 drops and permits that within passage 32 to raise diaphragm 30 off its seat, as FIG. 3 shows. The diaphram thus serves as a pressure-relief valve. Specifically, it permits the pressure within passage 32 and thus within chamber 25 to be relieved through a plurality of openings such as opening 51. As a consequence, the bias spring 24 can overcome the force exerted by the pressure within chamber 25. The flush-valve member 12 shown in FIG. 1 therefore rises, lifting its O-ring seal 52 off the main valve seat 14 and thereby allowing the tank to empty.

As is well known, toilets of this type operate by way of suction that results when the rising liquid level in the bowl drives water to the turn in a vertical conduit bend, where the pull of gravity then draws fluid down the reverse bend to siphon bowl contents out. The effectiveness of the desired suction depends significantly on the profile of flush-valve movement as the flush valve opens, so it is important that this opening-movement profile be repeatable. This is readily achieved by employing the bias spring to cause the valve-opening motion, because that motion is then essentially independent of line pressure so long as the pressure-relief path has much less flow resistance than the path by which the chamber is repressurized.

After the tank thus empties, the solenoid is operated to seat valve member 44 again. At least when the system is battery-operated, it is preferable for the solenoid to be of the latching variety. That is, it is preferable for it to require power to change state but not to require power to remain in either state. This contributes to battery longevity.

Figure 4:
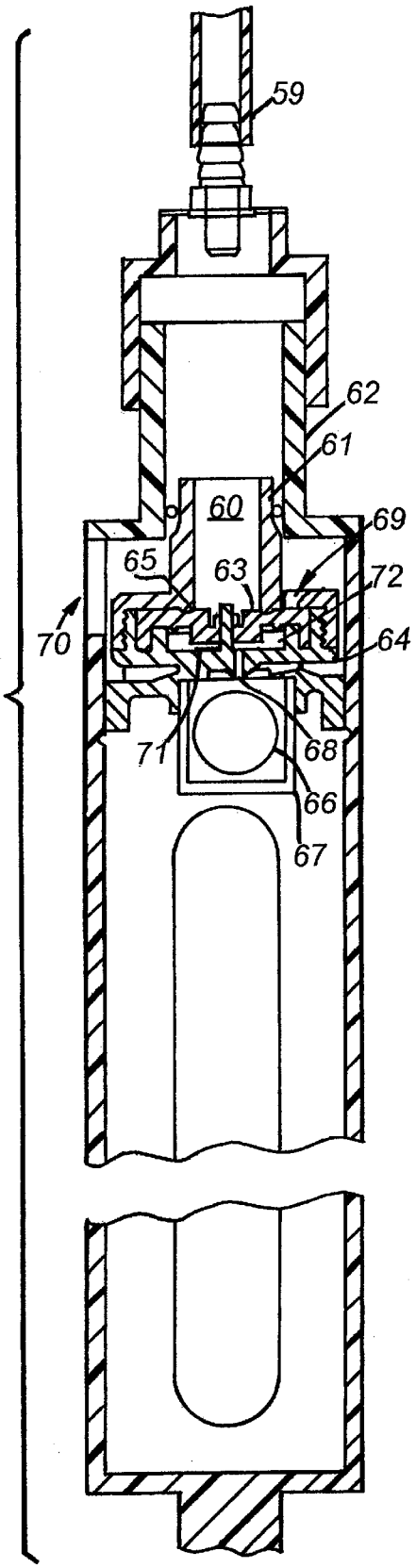
FIG. 4 is a cross-sectional view depicting FIG. 1's gravity-type flush valve in more detail.

With the valve member seated, the pressure above diaphragm 30 can again build to equal that below it, so diaphragm 30 again seats to cause pressure in chamber 25 to produce enough force to close this main flush valve 12 again. As a result, flow from FIG. 1's main line 59 fills the tank through a float-valve assembly best seen in FIG. 4. Specifically, water from line 59 flows through a main valve passage 60 formed by a valve cap 61 sealingly secured in a float-valve frame 62. A diaphragm 63 is held between the valve cap 61 and a valve plug 64 threadedly secured to the valve cap 61 and also sealed to the float-valve frame 62.

At rest, the resilient diaphragm 63 seats against a valve seat 65 that the valve cap 61 forms. So long as a ball float 66 disposed in a float cage 67 provided by the valve plug 64 does not plug a pressure-relief orifice 68, though, the pressure within passage 60 causes such a deformation of the resilient diaphragm 63 as to leave a clearance between it and the valve seat 65. So water from a passage 60 can flow around the valve seat 65 through a valve-cap opening 69 and openings 70 in the float-valve frame 62.

The resultant rising water in the tank eventually lifts the float 66 into a position in which it blocks the pressure-relief orifice 68. This prevents the escape of water that has bled through a high-flow-resistance orifice 71 into a chamber 72 that the diaphragm 63 forms with the valve plug 64. So the pressure within that chamber approaches that within the passage 60. Moreover, that pressure acts on the diaphragm 63's lower surface over a greater area than the same pressure does on the diaphragm's upper surface. The resultant upward force presses the diaphragm 63 against its seat 65 and prevents further flow from the high-pressure line 59 into the tank. In the illustrated embodiment, the water level at which this occurs can be adjusted by adjusting the height within the frame 62 of the cap 61, plug 64, and parts connected to them.

In some embodiments, a user will trigger a solenoid cycle manually by, for instance, using a push button. But the drawings instead illustrate arrangements for operating the solenoid automatically in response to sensed user activity. In FIG. 1, for instance, a control circuit 84 mounted in a water-tight enclosure 86 and powered by batteries 88 provides the solenoid drive current. To determine when to drive the solenoid, the control circuit 84 generates and transmits infrared light through optic fibers 90 to a lens 92 and thereby irradiates a target region. Another lens 94 collects light that a target has reflected, and optic fibers 96 conduct that light to a detector in the control circuit 84.

The particular control strategy that the control circuit employs will vary from embodiment to embodiment, but a typical approach is for the control circuit to assume an "armed" state when a target is detected. From that armed state, the subsequent absence of a target will, possibly after some delay, result in the solenoid's causing the flush valve to open and close in the manner described above.

Figure 5:
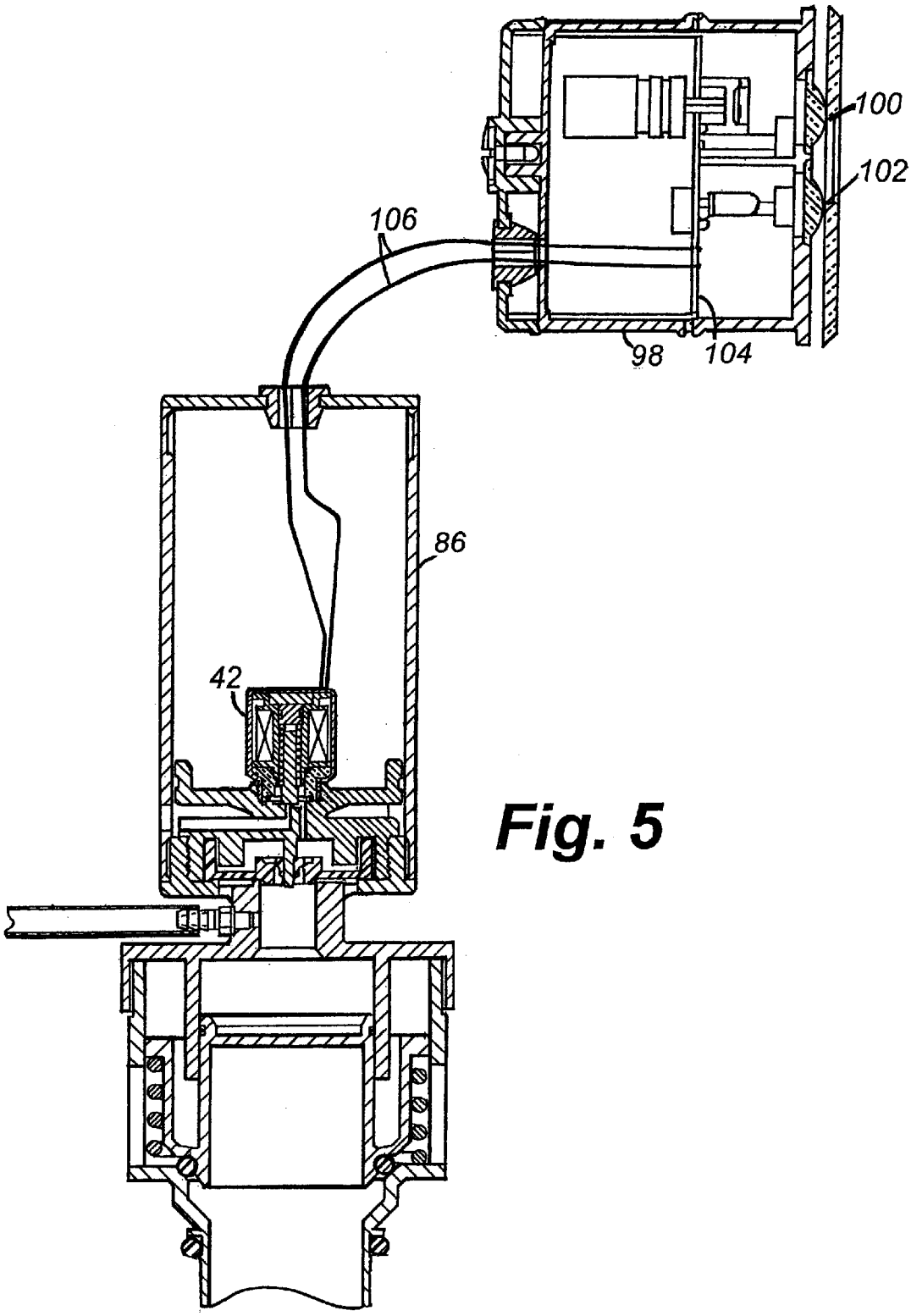
FIG. 5 is a cross-sectional view of an alternative flush-valve arrangement, in which solenoid-control circuitry is located remotely from a solenoid located in the flush-valve assembly.

In the FIG. 1 arrangement, it is only the object-sensor lenses that are disposed at the tank's exterior; all of the control circuitry is disposed inside the tank and, indeed, inside a water-tight enclosure disposed below the tank's high-water level. In contrast, FIG. 5 illustrates an approach in which an electronics enclosure 98 may be mounted, say, on the tank wall, above the tank's high-water line. Lenses 100 and 102, whose functions are the same as those of FIG. 1's lenses 92 and 94, can be mounted in the same enclosure as control circuitry 104, so there is no need for optic fibers to connect the lenses to the control circuitry. But the control circuitry is now remote from the solenoid 42, which remains in the watertight enclosure 86, so operator wires 106 lead from the control circuit 104 to the solenoid 42 to enable the control circuit to operate the solenoid.

An alternative, wireless approach would be a hybrid of the approaches that FIGS. 1 and 5 illustrate. Push-button or sensing circuitry in such an approach would be located remotely, as in FIG. 5, but the solenoid-drive circuitry would be local, as in FIG. 1. The remote circuitry would additionally include a wireless transmitter, and the local circuitry would include a wireless receiver responsive to the transmitter. For example, the transmitter and receiver may communicate by way of low-frequency—say, 125 kHz—electromagnetic waves. Such electromagnetic waves may be modulated by pulse trains so encoded as to minimize the effects of spurious reception from other sources. It may be preferable in wireless approaches for at least the local receiver to be located above the water line, but this is not required.

Figure 6:
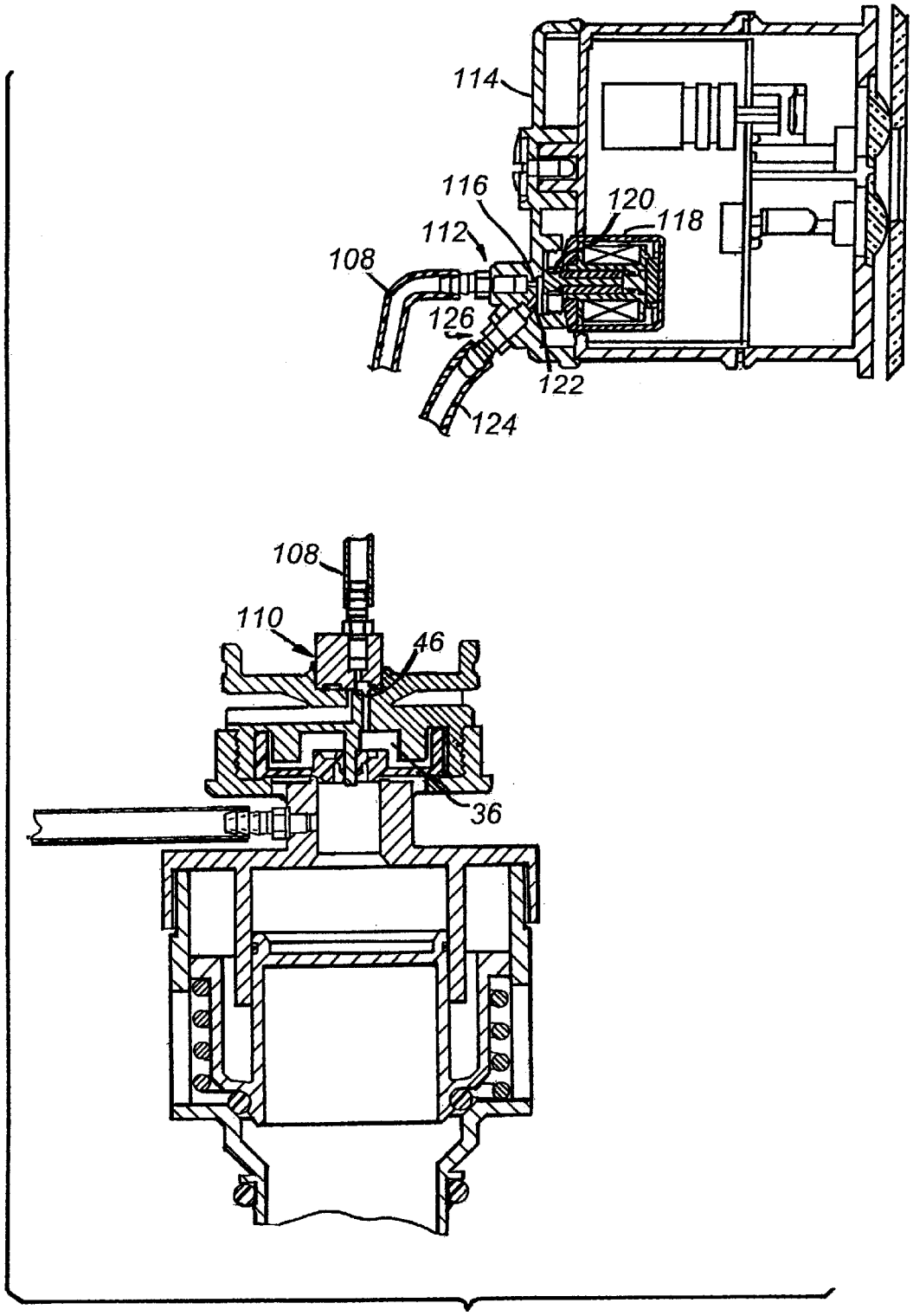
FIG. 6 is a cross-sectional view of another embodiment, one in which the solenoid as well as the solenoid-control circuitry is located remotely from the flush-valve assembly.

Whereas the FIG. 5 arrangement employs the operator wires 106 to couple the remote control elements to the local ones, FIG. 6 illustrates an arrangement in which a hydraulic line 108 performs that function. In the FIG. 6 arrangement, the passage 46 by which the pilot valve's upper chamber 36 is relieved communicates through an appropriate fitting 110 with the hydraulic line 108. Another fitting 112 on a control-circuit housing 114 places the hydraulic line 108 into communication with a valve passage 116 through which a solenoid 118 controls the flow.

In one state, the solenoid holds a valve member 120 in the position in which it prevents flow from passage 116 to a further passage 122. The pressure in the pilot valve's upper chamber 36 would otherwise be exhausted to the tank interior by way of an exhaust hose 124 secured to another fitting 126 on the control-circuit housing 114. Exhaust hose 124 is provided for those installations in which the control-circuit housing 114 is disposed outside the tank; such installations would need an exhaust hose to return water to the tank. If the housing 114 is instead mounted inside the tank (above the high-water line), such an exhaust hose is unnecessary.

Figure 7:
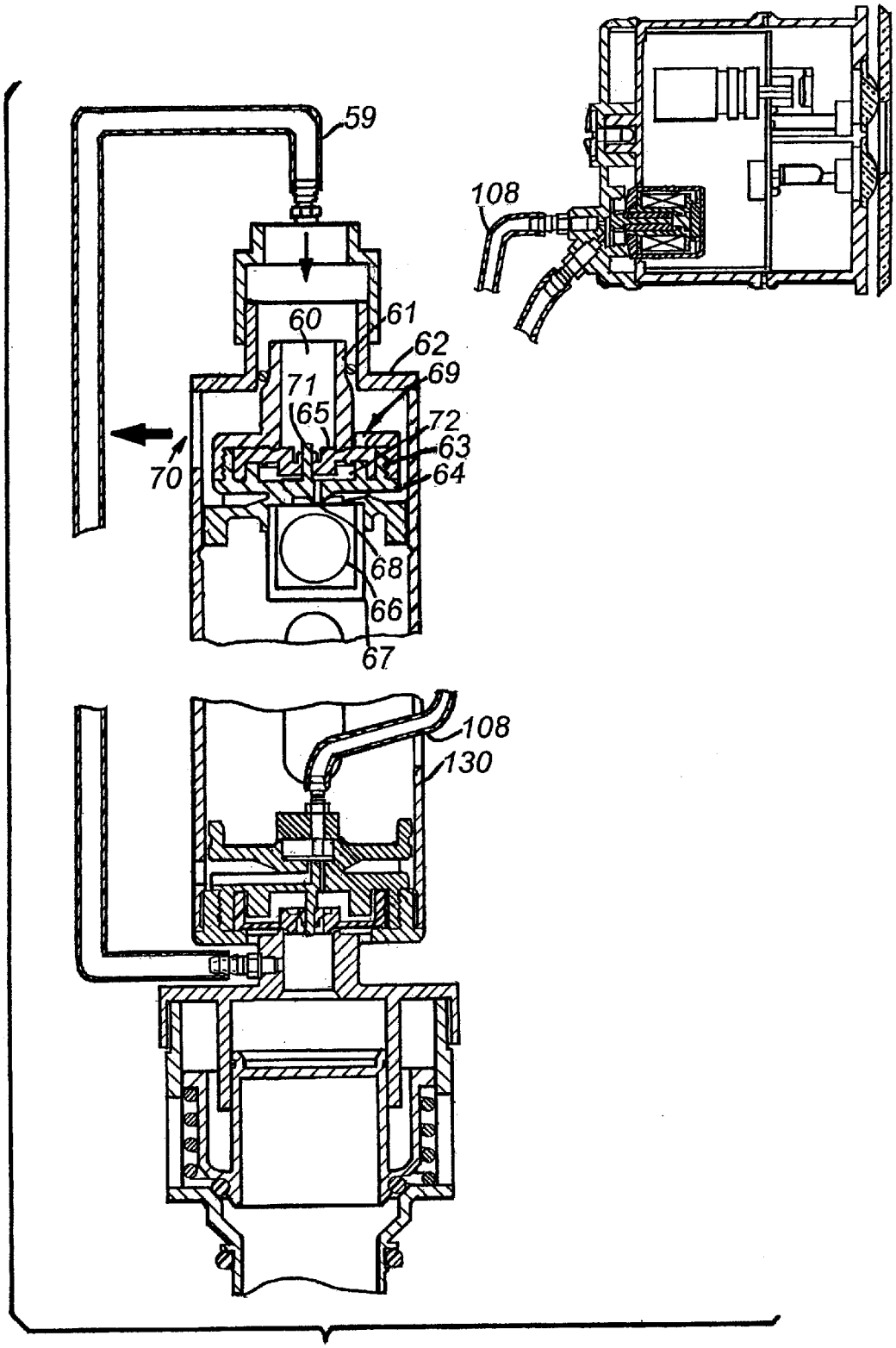
FIG. 7 is a cross-sectional view that illustrates an embodiment in which the float- and flush-valve assemblies share common elements.

Although the float-valve assembly is provided in FIG. 1 separately from the flush-valve assembly, FIG. 7 shows that the float- and flush-valve elements can both be provided in a single assembly. FIG. 7's frame 130 is mounted on the float-valve pilot assembly just as FIG. 1's watertight enclosure 86 is. In the particular arrangement of FIG. 7, hydraulic line 108 provides communication with the remote elements, so frame 130 does not need to provide watertight protection to any local elements. It simply serves the same function as FIG. 4's float-valve frame 62. In other versions, in which it is necessary to protect local elements from water in the tank, frame 130 can be arranged to provide such watertight protection.

Figure 8:
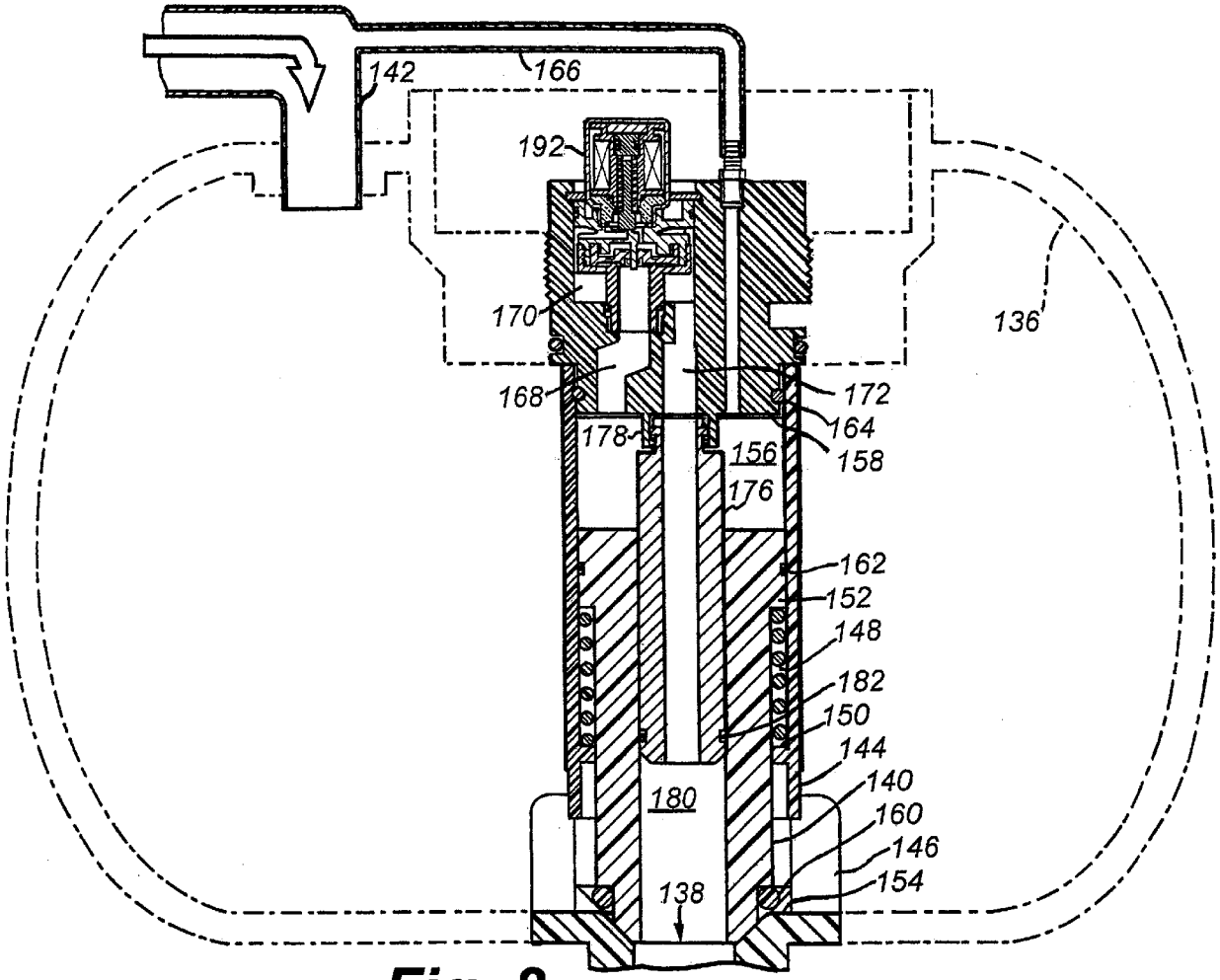
FIG. 8 is a cross-sectional view of a pressure-type embodiment.

In contrast to the flushers described so far, all of which are of the gravity type, the flusher of FIG. 8 is a pressure-type flusher of the tank variety. In a gravity-type flusher, water contained within the tank flows through the flush outlet under pressure that results solely from the depth of liquid in the tank; line pressure does not prevail in the tank. In contrast, the pressure vessel 136 through whose flush outlet 138 a flush-valve member 140 controls flow is always under pressure introduced from the main pressure line 142. The flush-valve member 140 is moveable within a cylinder 144 supported by fins 146 that extend upward from the base of the pressure vessel 136. A bias spring 148 acting between a ledge 150 provided by the cylinder 144 and a piston head 152 formed by the valve member 140 tends to lift the valve member 140 off its seat 154. But pressure in a chamber 156 formed by the cylinder 144 between the piston head 152 and a cap 158 keeps the flush-valve member 140 in the illustrated position, in which it squeezes an O-ring seal 160 against the valve seat 154. Seals 162 on the piston head and 164 on the cap help to prevent the escape from the chamber 156 of pressurized water that has been introduced into it by way of an input pressure line 166.

To cause the mechanism to flush, pressure in the chamber 156 is relieved by way of a pressure-relief conduit comprising a pilot-valve inlet passage 168, a pilot-valve outlet chamber 170, guide-tube inlet passage 172, a guide tube 176 secured to the cap 158 by a collar 178 that the cap forms, and a bore 180, formed by the flush-valve member 140, that receives the guide tube 176. Seals 182 on the guide tube prevent escape of fluid from the chamber 156.

A pressure-relief valve 184 operates similarly to pilot valves previously described to control flow through the pressure-relief conduit just described. Specifically, fluid from the pilot-valve inlet passage 168 is ordinarily prevented by diaphragm 186 from flowing around an annular valve seat 188 though valve-cap openings 190 into the pilot-valve outlet chamber 170. When the pressure-relief mechanism's solenoid 192 raises a valve member 194 so as to relieve the pressure above diaphragm 186 through passages 196 and 198, pressure below the diaphragm 186 lifts it off the valve seat 188 and permits relief of chamber 156's pressure through the pressure vessel 136's flush opening 138. By thus relieving the chamber pressure through the valve member itself, the illustrated flush mechanism avoids the need for a separate passage to the pressure-vessel exterior.

Figure 9:
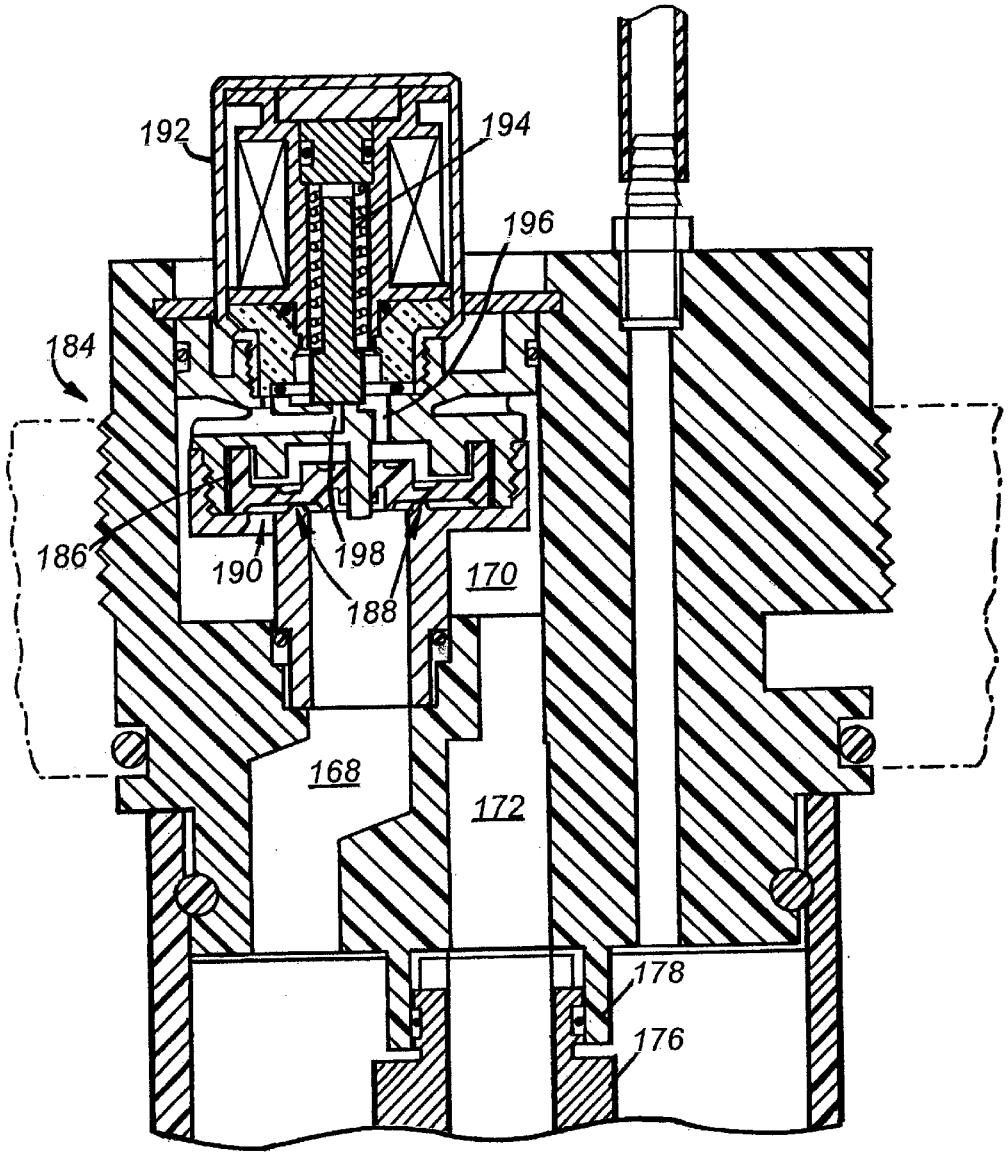
FIG. 9 is a more-detailed cross-sectional view of FIG. 8's pilot-valve arrangement.

Although FIG. 8 shows none of the circuitry for controlling the solenoid 192, such circuitry will be employed, of course. For example, it can be provided in any of the several ways described above in connection with the gravity-type arrangements. Also, although FIG. 8 shows the solenoid as located locally, it can instead be provided remotely, in a manner similar to that depicted in FIG. 6. For example, the pressure-relief passage could include conduits that are similar to FIG. 6's hoses 108 and 124 but communicate with FIG. 9's passages 196 and 198.

By employing the present invention's teachings, flushers adapted for automatic operation can be made simpler and more reliable. The invention thus constitutes a significant advance in the art.

What is claimed is:

1. A flusher comprising:

A) a tank forming a flush outlet by which liquid in the tank may leave the tank for flushing;

B) a flush-valve member biased to an unseated state, in which it permits flow from the tank through the flush outlet, and operable between its unseated state and a seated state, in which it prevents flow from the tank therethrough;

C) a flush-valve housing that forms a flush-valve chamber in which at least a portion of the flush-valve member is movably disposed, the flush-valve housing further forming a flush-valve chamber pressure-relief outlet and a line-pressure inlet that so admits water line pressure into the flush-valve chamber as to keep the valve in its seated state when water line pressure above a minimum hold pressure prevails in the flush-valve chamber; and D) a pressure-relief mechanism operable between a closed state, in which it prevents relief of flush-valve-chamber pressure through the flush-valve chamber pressure-relief outlet, and an open state, in which it relieves flush-valve-chamber pressure through the flush-valve chamber pressure-relief outlet.

2. A flusher as defined in claim 1 wherein:

A) the pressure-relief mechanism includes a pressure-relief conduit extending between a remote location and a local location, at which the flush-valve chamber is disposed;

B) the pressure-relief mechanism so operates as to permit relief of flush-valve chamber pressure through the flush-valve chamber pressure-relief outlet when flow through the pressure-relief conduit is permitted and to prevent relief of flush-valve chamber pressure through the flush-valve chamber pressure-relief outlet when flow through the pressure-relief conduit is prevented; and C) the pressure-relief mechanism further includes a remote valve disposed at a remote location, interposed in the pressure-relief conduit, and operable between a closed state, in which it prevents flow through pressure-relief conduit, and an open state, in which it permits flow through the pressure-relief conduit.

3. A flusher as defined in claim 2 wherein:

A) the flush mechanism further includes a liquid-level controller that fills the tank to a target liquid level;

B) the flush-valve chamber is disposed in the portion of the tank interior that is below the target liquid level; and C) the remote valve is disposed outside the portion of the tank interior that is below the target liquid level.

4. A flusher as defined in claim 1 wherein:

A) the pressure-relief mechanism further includes an object sensor, which generates an object-sensor output; and B) the pressure-relief mechanism operates between its open and closed states in accordance with the object-sensor output.

5. A flusher as defined in claim 4 wherein the object sensor includes:

A) a fiber-optic cable that extends between a local location and a remote location;

B) a sensor lens so disposed at the remote location as to focus light from a target region into the fiber-optic cable; and C) a sensor circuit, disposed at the local location, that generates an object-sensor output in accordance with light received from the fiber-optic cable.

6. A flusher as defined in claim 5 wherein:

A) the flush mechanism further includes a liquid-level controller that fills the tank to a target liquid level;

B) the remote location is outside the portion of the tank interior that is below the target liquid level;

C) the local location is inside the portion of the tank interior that is below the target liquid level.

7. A flusher as defined in claim 1 wherein the pressure-relief mechanism includes a latching solenoid and assumes its closed state when the latching solenoid is in one of its stable states and assumes its open state when the latching solenoid is in the other of its stable states.

8. A flusher as defined in claim 7 wherein the pressure-relief mechanism is battery-powered.

9. A flusher as defined in claim 1 wherein the pressure-relief mechanism is battery-powered.

* * * * *